US005794855A

United States Patent [19]

Ledford

[11] Patent Number: 5,794,855

[45] Date of Patent: Aug. 18, 1998

[54] PRECISION CONE-OVERSPRAY PROTECTOR

[76] Inventor: Bobie C. Ledford, 749 Stallion Cir., Fairfield, Calif. 94533

[21] Appl. No.: 774,762

[22] Filed: Dec. 30, 1996

[51] Int. Cl.[6] ..... B05B 1/28

[52] U.S. Cl. ..... 239/288; 239/104; 239/288.3; 239/288.5

[58] Field of Search ..... 239/104, 288, 239/288.3, 288.5

[56] References Cited

U.S. PATENT DOCUMENTS

| | | | |
|---|---|---|---|
| 117,396 | 7/1871 | Edgerton | 239/288.5 |
| 3,092,334 | 6/1963 | Peterson | 239/288.5 X |

FOREIGN PATENT DOCUMENTS

| | | | |
|---|---|---|---|
| 2746502 | 6/1978 | Germany | 239/104 |
| 454880 | 5/1975 | U.S.S.R. | 239/288 |

*Primary Examiner*—Kevin P. Shaver
*Assistant Examiner*—Robin O. Evans

[57] ABSTRACT

A new precision cone-overspray protector for applying sprayed materials to precise areas. The inventive device includes a hollow hood member having a narrow end and an enlarged end, made from a sheet material having overlapped edges which are secured together to maintain the shape of the hood member, and apparatus associated with the hood member for securing the hood member around a sprayer head of a spraying device.

8 Claims, 3 Drawing Sheets

PRECISION CONE-OVERSPRAY PROTECTOR

BACKGROUND OF THE INVENTION

1. Field of the Invention

The present invention relates to spraying devices and more particularly pertains to a new precision cone-overspray protector for applying sprayed materials to precise areas.

2. Description of the Prior Art

The use of spraying devices is known in the prior art. More specifically, spraying devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art spraying devices include U.S. Pat. No. 4,895,306; U.S. Pat. No. 5,139,200; U.S. Pat. No. 4,199,896; U.S. Pat. No. 4,302,040 and U.S. Pat. No. 4,524,912. All of the above patents disclose sprayers with shields to apply a sprayed material to a specific location. None of these patents teach a shield which is formed of a sheet material with overlapped edges secured together. Additionally, U.S. Pat. Des. 295,026 teaches a traffic cone. However, this patent does not teach using the cone with a spraying device.

While these devices fulfill their respective, particular objectives and requirements, the aforementioned patents do not disclose a new precision cone-overspray protector. The inventive device includes a hollow hood member having a narrow end and an enlarged end, made from a sheet material having overlapped edges which are secured together to maintain the shape of the hood member, and apparatus associated with the hood member for securing the hood member around a sprayer head of a spraying device.

In these respects, the precision cone-overspray protector according to the present invention substantially departs from the conventional concepts and designs of the prior art, and in so doing provides an apparatus primarily developed for the purpose of applying sprayed materials to precise areas.

SUMMARY OF THE INVENTION

In view of the foregoing disadvantages inherent in the known types of spraying devices now present in the prior art, the present invention provides a new precision cone-overspray protector construction wherein the same can be utilized for applying sprayed materials to precise areas.

The general purpose of the present invention, which will be described subsequently in greater detail, is to provide a new precision cone-overspray protector apparatus and kit which has many of the advantages of the spraying devices mentioned heretofore and many novel features that result in a new precision cone-overspray protector which is not anticipated, rendered obvious, suggested, or even implied by any of the prior art spraying devices, either alone or in any combination thereof.

To attain this, the present invention generally comprises a hollow hood member having a narrow end and an enlarged end, made from a sheet material having overlapped edges which are secured together to maintain the shape of the hood member, and apparatus associated with the hood member for securing the hood member around a sprayer head of a spraying device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new precision cone-overspray protector apparatus and kit which has many of the advantages of the spraying devices mentioned heretofore and many novel features that result in a new precision cone-overspray protector which is not anticipated, rendered obvious, suggested, or even implied by any of the prior art spraying devices, either alone or in any combination thereof.

It is another object of the present invention to provide a new precision cone-overspray protector which may be easily and efficiently manufactured and marketed.

It is a further object of the present invention to provide a new precision cone-overspray protector which is of a durable and reliable construction.

An even further object of the present invention is to provide a new precision cone-overspray protector which is susceptible of a low cost of manufacture with regard to both materials and labor, and which accordingly is then susceptible of low prices of sale to the consuming public, thereby making such precision cone-overspray protector economically available to the buying public.

Still yet another object of the present invention is to provide a new precision cone-overspray protector which provides in the apparatuses and methods of the prior art some of the advantages thereof, while simultaneously overcoming some of the disadvantages normally associated therewith.

Still another object of the present invention is to provide a new precision cone-overspray protector for applying sprayed materials to precise areas.

Yet another object of the present invention is to provide a new precision cone-overspray protector which includes a hollow hood member having a narrow end and an enlarged end, made from a sheet material having overlapped edges which are secured together to maintain the shape of the hood member, and apparatus associated with the hood member for securing the hood member around a sprayer head of a spraying device.

Still yet another object of the present invention is to provide a new precision cone-overspray protector that stops overspray of material onto areas not intended to be sprayed.

Even still another object of the present invention is to provide a new precision cone-overspray protector that saves money by reducing waste of sprayed material.

Yet still another object of the present invention is to provide a new precision cone-overspray protector which protects a person using a spraying device from the harmful effects of a sprayed material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
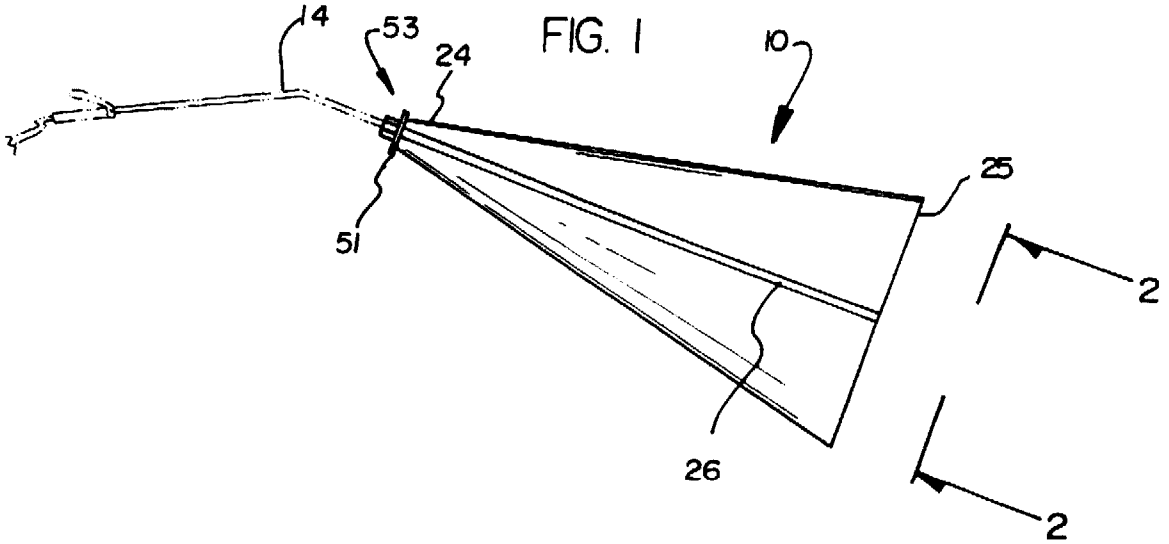
FIG. 1 is a perspective view of a new precision cone-overspray protector attached to a spray head of a spraying device.
Figure 2:
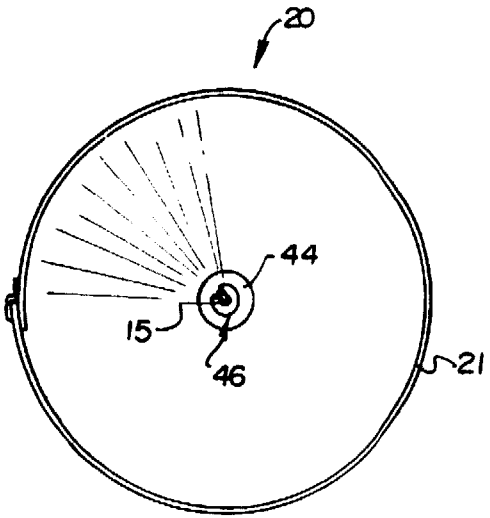
FIG. 2 is a view taken along line 2—2 of FIG. 1.

With reference now to the drawings, and in particular to FIGS. 1 through 6 thereof, a new precision cone-overspray protector embodying the principles and concepts of the present invention and generally designated by the reference numeral 10 will be described.

More specifically, it will be noted that the precision cone-overspray protector 10 comprises a hollow hood member 20 adapted for mounting to a spray wand 14 such that the spray head 15 of the wand is disposed within the hood member. The spray head is that portion of the wand generally defining the end region of the wand. The spray head includes an enlarged spray nozzle (not shown) at the very end of the wand, defining the output for the sprayed material.

As best illustrated in FIGS. 1 through 6, it can be shown that the hollow hood member 20 is comprised of a flexible sheet 21 having first and second edges 22 and 23, respectively. The sheet 21 is made of a lightweight material which can be readily rolled such that the edges 22,23 overlap, such as plastic, thick pressed paper, card board, and various metals. The two edges 22,23 are overlapped to form the shape of the hollow hood member. The hood member can have any desired shape, but is preferably cone-shaped or pyramid-shaped. The hood member 20 has a narrow end 24 and an enlarged end 25, with both ends 24,25 being open. The overlapped edges 22,23 define a seam 26 which extends the length of the member 20.

Figure 5:
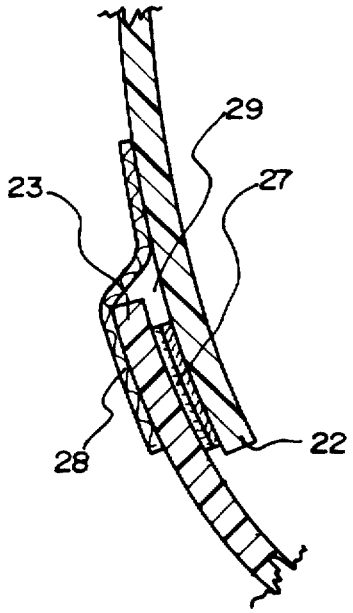
FIG. 5 is a cross sectional view taken along line 5—5 of FIG. 3.

The overlapped edges 22,23 are connected together by connecting means for maintaining the shape of the member 20. As illustrated in FIG. 5, such connecting means is a double sided tape 27 disposed between the overlapped edges. As is apparent, the double sided tape includes adhesive on both sides thereof for securely attaching the overlapped edges. An adhesive tape 28, such as duct tape, is disposed over the seam 26 and over the gap 29 between the overlapped edges 22,23, in order to supplement the connection force of the tape 27 and to protect the tape 27 from outside elements.

Figure 6:
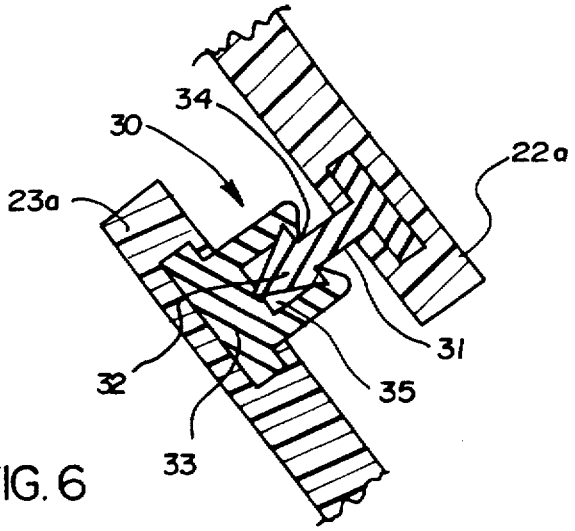
FIG. 6 is a cross sectional view similar to FIG. 5, but showing an alternate form of connection for the overlapped edges.

An alternate form of connection means is illustrated in FIG. 6. This connection means comprises a releasable connector 30 permitting the edges to be selectively attached/detached for unrolling the member 20. The connector 30 includes a male member 31 with an enlarged head 32 projecting from the first edge 22*a*, and a female member 33 connected to the second edge 23*a*. The female member 33 includes an open top 34 leading to a recess 35 shaped to releasably receive the head 32. The members 31,33 can be secured to the edges 22*a*,23*a* in any appropriate manner, such as by integrally forming the members with the edges or by securing the members to the edges using a fastener. As is apparent, by pulling on either edge 22*a*,23*a*, the head 32 can be released from engagement with the female member, allowing the user to unroll the member 20.

Attachment means 40 are used to attach the hood member 20 to the spray wand 14 such that the spray head 15 thereof is disposed inside of the hood member 20 adjacent the narrow end. The attachment means 40 includes a pipe 41 having threaded ends 42,43. The diameter of the pipe 41 is such that it freely permits passage of the spray head 15 therethrough, but is snugly received within the open, narrow end 24 of the member 20. A first washer 44 includes an aperture 45 sized to permit the washer to fit over the pipe 41. The washer 44 is disposed inside of the member 20 when assembled and engages the inside surface of the member 20. A first split nut 46 secures the washer 44 inside of the member 20. The nut 46 includes a top 47 and a threaded flange 48 extending from the top 47. The nut 46 screws onto the threaded end 42, pushing the washer 44 upwards and into contact with the inside surface of the member 20.

Figure 3:
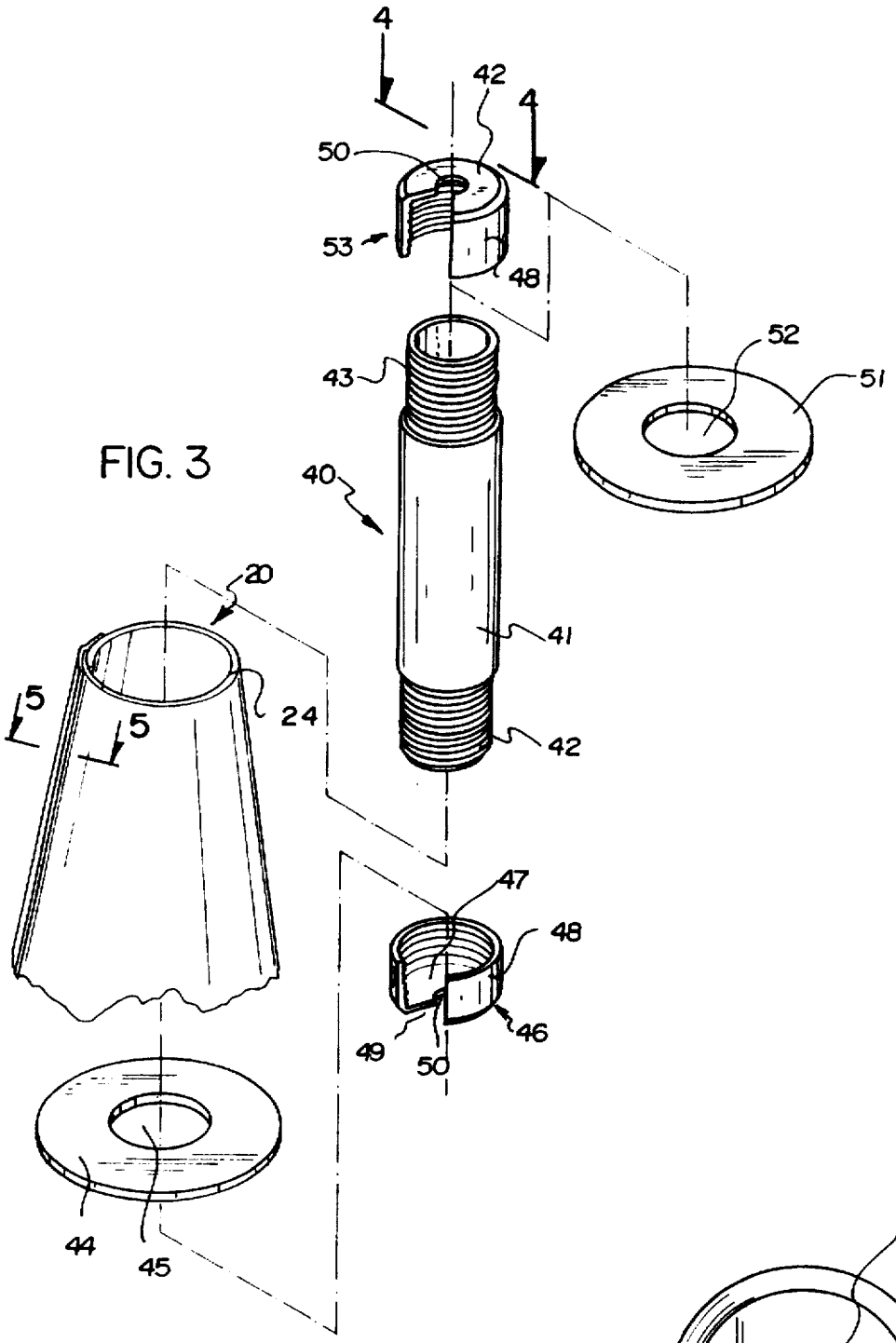
FIG. 3 is an exploded isometric illustration of the hood member and attachment means.
Figure 4:
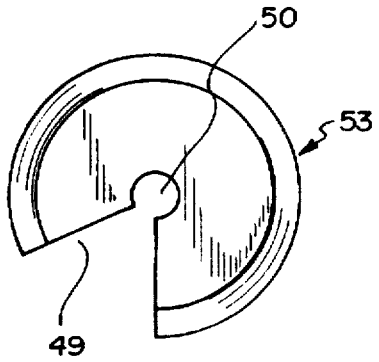
FIG. 4 is a view taken along line 4—4 of FIG. 3.

As shown in FIGS. 3 and 4, the nut 46 includes a gap 49 therein which permits passage of the tubular spray head pipe therethrough. The top 47 of the nut 46 includes a hole 50 permitting passage of the spray head therethrough. The spray head 15 is configured to include an enlarged spray nozzle (not shown) at its tip, having a diameter greater than the diameter of the hole 50. Thus by inserting the spray head into the gap 49 and subsequently pushing the nut sideways, the nut 46 is secured on the spray head 15. The enlarged spray nozzle prevents the nut from slipping off of the end of the spray head, since it cannot fit through the hole 50.

The attachment means 40 additionally includes a second washer 51 having an aperture 52, and a second split nut 53. The washer 51 and nut 53 are identical to the first washer 44 and first nut 46, and the details thereof need not be further described. However, the second washer 51 fits over the pipe 41 and engages the top of the open end 24, as can be seen in FIG. 1. The nut 53 is fit onto the wand 14 in a manner similar to the nut 46 fitting on the spray head 15, and is screwed onto the threaded end 43 to push the washer 51 into engagement with the open end 24. Thus the two washers 44,51 cooperate to clamp the member 20 and secure the spray head within the member.

It should be noted that the member 20, the connection means, and the attachment means 40 can be provided in a kit form for mounting on an existing spray wand. In this case, the hood member would come as an unrolled sheet material 21, which would be then rolled by the user into the hood member form. The sheet would be sized and shaped such that a desired hood shape is formed. The connection means could either be already attached to the edges 22,23, or could be secured by the user. The device would then be assembled by the user and secured to the spray wand.

In use, the member 20 is secured and attached to the spray head as described above. Depending upon the type of connection means used, the member can be unrolled to facilitate storage. For instance, the releasable connector 30 allows the user to detach the edges 22*a*,23*a* when the member is not in use, thus facilitating storage of the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An overspray protection shield for a sprayer head of a spraying system, comprising:

a hollow hood member having a narrow, first end and an enlarged, second end, said hollow hood member being formed of a sheet material having first and second edges, said edges being overlapped to define a seam along said hollow hood member, and means for connecting the overlapped edges together to maintain the shape of the hollow hood member;

attachment means associated with the hood member for mounting the spray head within the hood member adjacent the first end thereof;

wherein the connecting means comprises an adhesive;

wherein the adhesive comprises a double-sided adhesive tape disposed between the overlapped edges; and adhesive tape disposed over the seam.

2. The overspray protection shield of claim 1 wherein the attachment means comprises a pipe extending through the first end of the hood member, said pipe having first and second threaded ends, a first washer inside of the hood member and disposed over said first threaded end, and a threaded, split nut inside of the hood member and screwed onto said first threaded end, said split nut including an aperture therein for receiving the sprayer head therethrough.

3. An overspray protection shield for a sprayer head of a spraying system, comprising:

a hollow hood member having a narrow, first end and an enlarged, second end, said hollow hood member being formed of a sheet material having first and second edges, said edges being overlapped to define a seam along said hollow hood member, and means for connecting the overlapped edges together to maintain the shape of the hollow hood member;

attachment means associated with the hood member for mounting the spray head within the hood member adjacent the first end thereof; and wherein the attachment means comprises a pipe extending through the first end of the hood member, said pipe having first and second threaded ends, a first washer inside of the hood member and disposed over said first threaded end, and a threaded, split nut inside of the hood member and screwed onto said first threaded end, said split nut including an aperture therein for receiving the sprayer head therethrough.

4. The overspray protection shield of claim 3, wherein the connecting means comprises a male member connected to the first edge of the sheet material, and a female member connected to the second edge of the sheet material;

said male member having a substantially triangular enlarged head portion;

said female member having a pair of opposing walls defining a recess, each wall having protrusion extending inwardly from a respective free end of said wall; and said male member being insertable into said recess whereby said enlarged head of said male member is held within said recess by said protrusions.

5. An overspray protection shield kit for forming, and mounting, a shield over a sprayer head of a spraying system, comprising:

a flexible, sheet material having first and second edges, said sheet material being sized such that it forms a hollow hood member having a narrow, first end and an enlarged, second end when the first and second edges are overlapped;

means for connecting the first and second edges together when the edges are overlapped; and attachment means adapted for association with the first end and configured for mounting the spray head within the hood member;

wherein the connecting means comprises a double-sided adhesive tape; and an adhesive tape sized for disposition over a seam formed by the overlapped edges.

6. The overspray protection shield kit of claim 5 wherein the attachment means comprises a pipe having first and second threaded ends, a first washer sized for fitting over said first threaded end, a second washer sized for fitting over the second threaded end, a first threaded, split nut sized for engagement with said first threaded end, said first split nut including an aperture therein sized for receiving the sprayer head therethrough, and a second threaded, split nut sized for engagement with said second threaded end.

7. An overspray protection shield kit for forming, and mounting, a shield over a sprayer head of a spraying system, comprising:

a flexible, sheet material having first and second edges, said sheet material being sized such that it forms a hollow hood member having a narrow, first end and an enlarged, second end when the first and second edges are overlapped;

means for connecting the first and second edges together when the edges are overlapped; and attachment means adapted for association with the first end and configured for mounting the spray head within the hood member; and wherein the attachment means comprises a pipe having first and second threaded ends, a first washer sized for fitting over said first threaded end, a second washer sized for fitting over the second threaded end, a first threaded, split nut sized for engagement with said first threaded end, said first split nut including an aperture therein sized for receiving the sprayer head therethrough, and a second threaded, split nut sized for engagement with said second threaded end.

8. The overspray protection shield kit of claim 7, wherein the connecting means comprises a male member connected to the first edge of the sheet material, and a female member connected to the second edge of the sheet material;

said male member having a substantially triangular enlarged head portion;

said female member having a pair of opposing walls defining a recess, each wall having protrusion extending inwardly from a respective free end of said wall; and said male member being insertable into said recess whereby said enlarged head of said male member is held within said recess by said protrusions.

* * * * *